US006096685A

United States Patent [19]

Pope et al.

[11] Patent Number: 6,096,685

[45] Date of Patent: Aug. 1, 2000

[54] CROSS-LINKED RECEIVING ELEMENT FOR THERMAL DYE TRANSFER

[75] Inventors: Brian T. Pope, Penfield; Teh-Ming Kung, Rochester, both of N.Y.

[73] Assignee: Eastman Kodak Company, Rochester, N.Y.

[21] Appl. No.: 09/203,858

[22] Filed: Dec. 2, 1998

[51] Int. Cl.[7] ..... B41M 5/035; B41M 5/38

[52] U.S. Cl. ..... 503/227; 428/195; 428/412; 428/423.1; 428/913; 428/914

[58] Field of Search ..... 8/471; 428/195, 428/412, 423.1, 913, 914; 503/227

[56] References Cited

U.S. PATENT DOCUMENTS 5,266,551 11/1993 Bailey et al. ..... 503/227

*Primary Examiner*—Bruce H. Hess
*Attorney, Agent, or Firm*—Harold E. Cole

[57] ABSTRACT

A dye-receiving element for thermal dye transfer includes a support having on one side thereof a dye image receiving layer. Receiving elements of the invention are characterized in that the dye image-receiving layer primarily comprises a mixture of a crosslinked polymer network being formed by the reaction of a multifunctional isocyanate with:

a) a polycarbonate polyol having at least two terminal hydroxy groups and an average molecular weight of about 1000 to about 10,000, and b) an aliphatic glycol having at least one of the following formulas:

$$HO—(CH_2)_n—OH$$

$$HO—[(CH_2)_n—O]_m—H \text{ or}$$

$$HO—[(CH_2)_5—CO_2]_p—[(CH_2)_n—O]_m—H$$

where n is between about 3 and about 10, m is between about 3 and about 60, and p is between about 1 and about 16.

20 Claims, No Drawings

CROSS-LINKED RECEIVING ELEMENT FOR THERMAL DYE TRANSFER

FIELD OF THE INVENTION

This invention relates to dye-receiving elements used in thermal dye transfer, and more particularly to a polymeric dye image-receiving layer for such elements.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye donor elements used in thermal dye transfer generally include a support bearing a dye layer comprising heat transferable dye and a polymeric binder. Dye receiving elements generally include a support bearing on one side thereof a dye image-receiving layer. The dye image-receiving layer conventionally comprises a polymeric material chosen from a wide assortment of compositions for its compatibility and receptivity for the dyes to be transferred from the dye donor element. The polymeric material must also provide adequate light stability for the transferred dye images. Many of the polymers which provide these desired properties, however, often lack the desired strength and integrity to stand up to the rigors of thermal printing. For example, a significant problem which can be encountered during thermal printing is sticking of the dye donor to the receiver. Gloss and abrasion resistance may also be marginal with many receiving layer polymers.

Increasing the hardness of the receiver layer with polymers having higher glass transition temperatures (Tg) can improve physical properties, but penetration of the dye into such layers may be impaired.

An alternate approach to achieve improved film properties is to crosslink the polymer. Crosslinking may be achieved in a variety of different ways, including reaction curing, catalyst curing, heat curing, and radiation curing. In general, a crosslinked polymer receiver layer may be obtained by crosslinking and curing a polymer having a crosslinkable reaction group with an additive having a crosslinkable reaction group, as is discussed in EPO 394 460, the disclosure of which is incorporated by reference. This reference, e.g., discloses receiving layers comprising polyester polyols crosslinked with multifunctional isocyanates. While such crosslinked polyester receiving layers are generally superior in resistance to sticking compared to non-crosslinked polyesters, light stability for transferred image dyes may still be a problem.

DESCRIPTION OF RELATED ART

U.S. Pat. No. 5,266,551 relates to a dye-image receiving layer for thermal dye transfer wherein the receiving layer comprises a crosslinked polymer network formed by the reaction of multifunctional isocyanates with polycarbonate polyols having two terminal hydroxy groups. However, there is a problem with this dye image-receiving layer in that it has an undesirable sticking between the dye-donor element and the dye-receiving element during the dye transfer printing process.

It is an object of this invention to provide a dye image-receiving element for thermal dye transfer processes having excellent dye uptake and image stability, and which will also not stick to a dye-donor element after a dye image is transferred. It is a further object of the invention to be able to coat such a receiving layer with a minimum amount of non-chlorinated solvent.

SUMMARY OF THE INVENTION

These and other objects are achieved in accordance with the invention comprising a dye-receiving element comprising a crosslinked polymer network being formed by the reaction of a multifunctional isocyanate with:

a) a polycarbonate polyol having at least two terminal hydroxy groups and an average molecular weight of about 1000 to about 10,000, and b) an aliphatic glycol having at least one of the following formulas:

$$HO—(CH_2)_n—OH$$

$$HO—[(CH_2)_n—O]_m—H \text{ or}$$

$$HO—[(CH_2)_5—CO_2]_p—[(CH_2)_n—O]_m—H$$

where n is between about 3 and about 10,
m is between about 3 and about 60, and
p is between about 1 and about 16.

An improvement in the undesirable sticking between the dye-donor element and the receiving element is achieved by this receiving element, while the superior properties, such as image stability and fingerprint resistance, of the resulting image-receiving layer are fully maintained.

DESCRIPTION OF THE PREFERRED EMBODIMENTS

The crosslinked polymers of the invention may be made by using the polycarbonate polyol polymer of U.S. Pat. No. 5,266,551 and adding to it the aliphatic glycol described above. The aliphatic glycol and the polycarbonate polyol then react with the multifunctional isocyanate during drying to form a three-dimensional crosslinked network.

In a preferred embodiment of the invention, the crosslinked polymer network has the formula:

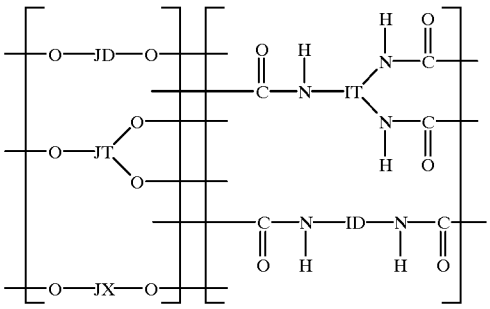

wherein:

JD and JT together represent from 50 to 100 mol % polycarbonate segments derived from a polycarbonate polyol having an average molecular weight of from about 1000 to about 10,000 and from 0 to 50 mol % segments derived from a polyol having a molecular weight of less than about 1000;

JX represents aliphatic glycol segments derived from said aliphatic glycol having an average molecular weight from about 100 to about 11,000; and ID and IT each independently represent aliphatic, cycloaliphatic, arylaliphatic, or aromatic radicals of multifunctional isocyanate units.

In a preferred embodiment of the invention, the polycarbonate polyol comprises bisphenol A derived units and diethylene glycol derived units. In another preferred embodiment, the terminal hydroxy groups of the polycarbonate polyol comprises aliphatic hydroxyl groups. In still another preferred embodiment, the terminal hydroxy groups of the polycarbonate polyols comprise phenolic groups. In yet still another preferred embodiment, the terminal hydroxy groups of the polycarbonate polyol comprises a mixture of phenolic groups and aliphatic hydroxyl groups. In still another preferred embodiment, at least 50 mol % of said multifunctional isocyanate is at least trifunctional. In another preferred embodiment, the polyol and multifunctional isocyanate are reacted to form the crosslinked polymer network in amounts such that the equivalent of polyol hydroxyl groups is from 60 to 140% of the equivalent of isocyanate groups. In yet still another preferred embodiment, the glycol has the formula:

$$HO—[(CH_2)_n—O]_m—H$$

where n is 4, and m is between about 8 and about 40.

The support for the dye-receiving element of the invention may be a polymeric, a synthetic paper, a cellulosic paper support, transparent supports such as poly(ethylene terephthalate) or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, barium sulfate, zinc oxide, etc., may be added to the polymeric layer to provide reflectivity. In addition, a subbing layer may be used over this polymeric layer in order to improve adhesion to the dye image-receiving layer.

Such subbing layers are disclosed in U.S. Pat. Nos. 4,748,150; 4,965,238; 4,965,239 and 4,965,241, the disclosures of which are incorporated by reference. The receiver element may also include a backing layer such as those disclosed in U.S. Pat. No. 5,011,814 and 5,096,875, the disclosures of which are incorporated by reference.

The invention polymers may be used in a receiving layer alone or in combination with other receiving layer polymers. Receiving layer polymers which may be used with the polymers of the invention include polycarbonates, polyurethanes, polyesters, polyvinyl chlorides, poly(styrene-co-acrylonitrile), poly(caprolactone) or any other receiver polymer and mixtures thereof.

The dye image-receiving layer may be present in any amount which is effective for its intended purpose. In general, good results have been obtained at a receiver layer concentration of from about 0.5 to about 10 g/m$^2$.

While the receiving layer of the invention comprising a crosslinked polymer network formed by the reaction of multifunctional isocyanates with polycarbonate polyols inherently provides resistance to sticking during thermal printing, sticking resistance may be even further enhanced by the addition of release agents to the dye receiving layer, such as silicone based compounds, as is conventional in the art.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803 and 5,023,228, the disclosures of which are incorporated by reference. Specific examples of such dyes include the following:

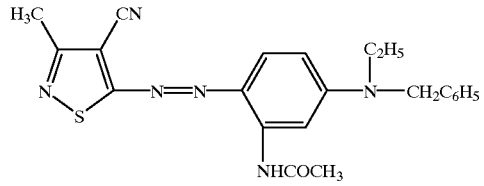

Magenta Dye M-1

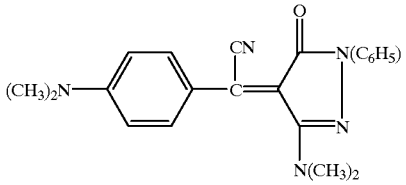

Magenta Dye M-2

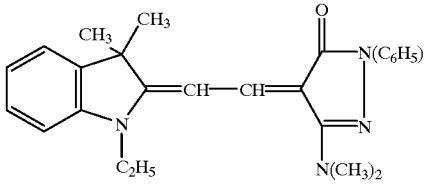

Yellow Dye Y-1

-continued

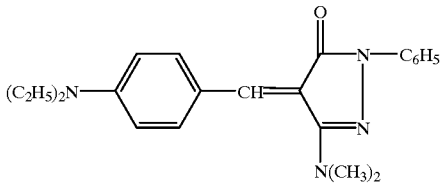

Yellow Dye Y-2

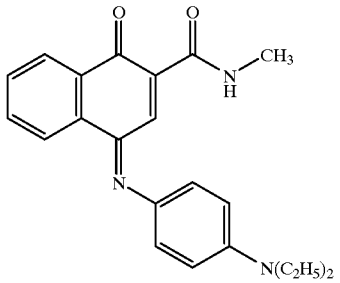

Cyan Dye C-1

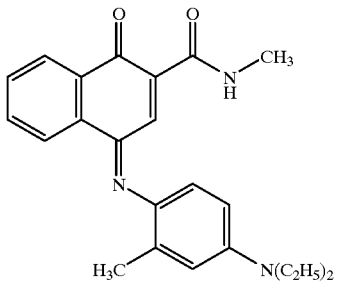

Cyan Dye C-2

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention;

EXAMPLES

Example 1

Control Receiver C-1

This element was prepared by first extrusion-laminating a paper core with a 38 μm thick micro voided composite film (OPPalyte® 350TW, Mobil Chemical Co.) as disclosed in U.S. Pat. No. 5,244,861. The composite film side of the resulting laminate was then coated with a dye-receiving layer of C1 polycarbonate polyol (2.36 g/m$^2$) as disclosed in U.S. Pat. No. 5,266,551; Desmondur® N3300 hexamethylene diisocyanate resin (Bayer Corp.) (0.147 g/m$^2$); Desmondur® Z-4370/2 isophorone diisocyanate resin (Bayer Corp.) (0.590 g/m$^2$); dibutyltin diacetate catalyst (Air Products Co.) (0.008 g/m$^2$); diphenyl phthalate (0.422 g/m$^2$); Fluorad FC-431® surfactant (3M Corporation) (0.017 g/m$^2$), and DC 510 surfactant (Dow Coming Corp.) (0.008 g/m$^2$).

Element E-1 of the Invention

This element was prepared similar to C-1 except that the polycarbonate polyol was employed at 2.024 g/m$^2$; the Desmondur® N3300 hexamethylene diisocyanate resin was employed at 0.169 g/m$^2$; the Desmondur® Z-4370/2 isophorone diisocyanate resin was employed at 0.679 g/m$^2$; and a polyether glycol, Terathane® 650 (DuPont Co.) (mw 650) (0.225 g/m$^2$) was added. (The slight differences in the dry coverage of the various components were made to maintain a stoichiometric equivalency.)

Element E-2 of the Invention

This element was prepared similar to C-1 except that the polycarbonate polyol was employed at 2.056 g/m$^2$; the Desmondur® N3300 hexamethylene diisocyanate resin was employed at 0.162 g/m$^2$; the Desmondur® Z-4370/2 isophorone diisocyanate resin was employed at 0.650 g/m$^2$; and a polyether glycol, Terathane® 1000 (DuPont Co.) (mw 1000) (0.228 g/m$^2$) was added.

Element E-3 of the Invention

This element was prepared similar to C-1 except that the polycarbonate polyol was employed at 2.092 g/m$^2$; the Desmondur® N3300 hexamethylene diisocyanate resin was employed at 0.155 g/m$^2$; the Desmondur® Z-4370/2 isophorone diisocyanate resin was employed at 0.618 g/m$^2$; and a polyether glycol, Terathane® 1400 (DuPont Co.) (mw 1400) (0.232 g/m ) was added.

Element E-4 of the Invention

This element was prepared similar to C-1 except that the polycarbonate polyol was employed at 2.126 g/m$^2$; the Desmondur® N3300 hexamethylene diisocyanate resin was employed at 0.147 g/m$^2$; the Desmondur® Z-4370/2 isophorone diisocyanate resin was employed at 0.588 g/m$^2$; and a polyether glycol, Terathane® 2900 (DuPont Co.) (mw 2900) (0.236 g/m$^2$) was added.

Dye-Donor Element

A black dye-donor element was prepared by gravure coating and consisted of a 6 μm poly(ethylene terephthalate) support which was subbed on one side with 0.13 g/m$^2$ of Tyzor TBT® (a titanium tetra-n-butoxide from DuPont) in an 85%/15% propyl acetate/butanol solvent mixture.

On the subbed side of the support the following slipping layer was coated: 0.45 g/m$^2$ of CAP482-0.5 (cellulose acetate propionate, 0.5 sec viscosity, from Eastman Chemicals Co.); 0.08 g/m$^2$ CAP482-20 (cellulose acetate propionate, 20 sec viscosity, from Eastman Chemicals Co.);

0.01 g/m$^2$ PS513 ® (an aminopropyl diethyl-terminated polydimethylsiloxane from Petrarch Systems, Inc.); 0.0003 g/m$^2$ p-toluenesulfonic acid; 0.03 g/m$^2$ Montan wax slurry; and a solvent mixture of 66.5% toluene/28.5% methanol/5% cyclopentanone.

On the unsubbed side of the support was coated the following dye layer: 0.06 g/m$^2$ of the second yellow dye illustrated above; 0.09 g/m$^2$ of the second magenta dye illustrated above; 0.02 g/m$^2$ of the first magenta dye illustrated above; 0.20 g/m$^2$ of the first cyan dye illustrated above; 0.56 g/m$^2$ of CAP482-0.5; 0.002 g/m$^2$ of FC430® (a fluorinated surfactant from 3M Company); 0.07 g/m$^2$ silica dispersion (see below); and a solvent mixture of 20% n-propanol/80% toluene.

The silica dispersion consisted of the following: 0.27 g/m$^2$ of TS-60 ® silica (Cabot Corp.); 0.03 g/m$^2$ of Solsperse 2400( dispersing agent from ICI; and 0.11 g/m$^2$ CAP4820.5.

Test conditions

The above dye-donor element and receiver elements were subjected to multiple printing on a production model Kodak XLS8600 PS Printer. The image used for the multiple printing on the elements is 13 cm by 23 cm with 1 cm random density squares from Dmin to Dmax, randomly distributed within.

Between each print the element was inspected for uniformity within each 1 cm square of the imaged element. When sticking occurs between the dye-donor and the dye-receiver interface, the dye and dye binder from the dye donor release from its support and transfer over to the dye receiver element. This results in an area of nonuniform optical density due to excessive dye and/or binder transferred to the receiver element during the printing process.

Each receiver element is printed, one image on top of the next, until a sticking phenomena is observed. This is designated as "prints-to-fail". The print at which sticking occurred is recorded, up to the sixth print. The results are summarized in the following Table.

TABLE 1

| Element | Polyether Glycol | Prints-to-fail |
|---|---|---|
| C-1 | None | 2 |
| E-1 | Terathane ® 650 | 3 |
| E-2 | Terathane ® 1000 | 3 |
| E-3 | Terathane ® 1400 | >6 |
| E-4 | Terathane ® 2900 | >6 |

The above results show that the addition of a polyether glycol in accordance with the invention provide an improvement in donor-receiver sticking in comparison to the control element 1.

Example 2

Control Element 2

This element was prepared similar to C-1 except that the polycarbonate polyol was employed at 2.624 g/m$^2$; the Desmondur® N3300 hexamethylene diisocyanate resin was employed at 0.381 g/m$^2$; the Desmondur® Z-4370/2 isophorone diisocyanate resin was employed at 0.163 g/m$^2$ and the diphenyl phthalate was employed at 0.352 g/m$^2$.

Control Element 3-Glycol Outside Scope Of Invention

This element was prepared similar to C-2 except that the polycarbonate polyol was employed at 2.281 g/m$^2$; the Desmondur® N3300 hexamethylene diisocyanate resin was employed at 0.444 g/m$^2$; the Desmondur® Z-4370/2 isophorone diisocyanate resin was employed at 0.190 g/m$^2$; and an ethylene glycol (mw 600) (0.253 g/m$^2$) was added.

Control Element 4-Glycol Outside Scope Of Invention

This element was prepared similar to C-2 except that the polycarbonate polyol was employed at 2.353 g/m$^2$; the Desmondur® N3300 hexamethylene diisocyanate resin was employed at 0.388 g/m$^2$; the Desmondur® Z-4370/2 isophorone diisocyanate resin was employed at 0.166 g/m$^2$; and an ethylene glycol (mw 1500) (0.261 g/m$^2$) was added.

Control Element 5-Glycol Outside Scope Of Invention

This element was prepared similar to C-2 except that the polycarbonate polyol was employed at 2.380 g/m$^2$; the Desmondur® N3300 hexamethylene diisocyanate resin was employed at 0.366 g/m$^2$; the Desmondur® Z-4370/2 isophorone diisocyanate resin was employed at 0.157 g/m$^2$; and an ethylene glycol (mw 3400) (0.264 g/m$^2$) was added.

Control Element 6-Glycol Outside Scope Of Invention

This element was prepared similar to C-2 except that the polycarbonate polyol was employed at 2.392 g/m$^2$; the Desmondur® N3300 hexamethylene diisocyanate resin was employed at 0.358 g/m$^2$; the Desmondur® Z-4370/2 isophorone diisocyanate resin was employed at 0.153 g/m$^2$; and an ethylene glycol (mw 6800) (0.266 g/m$^2$) was added.

Control Element 7-Glycol Outside Scope Of Invention

This element was prepared similar to C-2 except that the polycarbonate polyol was employed at 2.313 g/m$^2$; the Desmondur® N3300 hexamethylene diisocyanate resin was employed at 0.418 g/m2; the Desmondur® Z-4370/2 isophorone diisocyanate resin was employed at 0.179 g/m$^2$; and a polycaprolactone glycol, (mw 830) (0.257 g/m$^2$) was added.

Control Element 8-Glycol Outside Scope Of Invention

This element was prepared similar to C-2 except that the polycarbonate polyol was employed at 2.343 g/m$^2$; the Desmondur® N3300 hexamethylene diisocyanate resin was employed at 0.396 g/m$^2$; the Desmondur® Z-4370/2 isophorone diisocyanate resin was employed at 0.170 g/m$^2$; and a polycaprolactone glycol, (mw 1250) (0.260 g/m$^2$) was added.

Control Element 9-Glycol Outside Scope Of Invention

This element was prepared similar to C-2 except that the polycarbonate polyol was employed at 2.365 g/m$^2$; the Desmondur® hexamethylene diisocyanate resin was employed at 0.378 g/m$^2$; the Desmondur® Z-4370/2 isophorone diisocyanate resin was employed at 0.162 g/m$^2$; and a polycaprolactone glycol, (mw 2000) (0.263 g/m ) was added.

Control Element 10-Glycol Outside Scope Of Invention

This element was prepared similar to C-2 except that the polycarbonate polyol was employed at 2.377 g/m$^2$; the Desmondur® N3300 hexamethylene diisocyanate resin was employed at 0.369 g/m$^2$; the Desmondur® Z-4370/2 isophorone diisocyanate resin was employed at 0.158 g/m$^2$; and a polycaprolactone glycol, (mw 3000) (0.264 g/m$^2$) was added.

E-5 of the invention-Glycol Within Scope Of Invention

This element was prepared similar to C-2 except that the polycarbonate polyol was employed at 2.234 g/m2; the Desmondur® N3300 hexamethylene diisocyanate resin was employed at 0.480 g/m$^2$; the Desmondur® Z-4370/2 isophorone diisocyanate resin was employed at 0.206 g/m$^2$; and a polypropylene glycol, (mw 425) (0.248 g/m$^2$) was added.

E-6 of the Invention-Glycol Within Scope Of Invention

This element was prepared similar to C-2 except that the polycarbonate polyol was employed at 2.301 g/m$^2$; the Desmondur® N3300 hexamethylene diisocyanate resin was employed at 0.428 g/m$^2$; the Desmondur® Z-4370/2 isophorone diisocyanate resin was employed at 0.183 g/m$^2$; and a polypropylene glycol, (mw 725) (0.256 g/m$^2$) was added.

E-7 of the Invention-Glycol Within Scope Of Invention

This element was prepared similar to C-2 except that the polycarbonate polyol was employed at 2.328 g/m$^2$; the Desmondur® N3300 hexamethylene diisocyanate resin was employed at 0.407 g/m2; the Desmondur® Z-4370/2 isophorone diisocyanate resin was employed at 0.174 g/m$^2$; and a polypropylene glycol, (mw 1000) (0.259 g/m$^2$) was added.

E-8 of the Invention-Glycol Within Scope Of Invention

This element was prepared similar to C-2 except that the polycarbonate polyol was employed at 2.365 g/m$^2$; the Desmondur® N3300 hexamethylene diisocyanate resin was employed at 0.378 g/m$^2$; the Desmondur® Z-4370/2 isophorone diisocyanate resin was employed at 0.162 g/m$^2$; and a polypropylene glycol, (mw 2000) (0.263 g/m$^2$) was added.

E-9 of the Invention-Glycol Within Scope Of Invention

This element was prepared similar to C-2 except that the polycarbonate polyol was employed at 2.377 g/m$^2$; the Desmondur® N3300 hexamethylene diisocyanate resin was employed at 0.369 g/m$^2$; the Desmondur® Z-4370/2 isophorone diisocyanate resin was employed at 0.158 g/m$^2$; and a polypropylene glycol, (mw 3000) (0.264 g/m$^2$) was added.

E-10 of the Invention-Glycol Within Scope Of Invention

This element was prepared similar to C-2 except that the polycarbonate polyol was employed at 2.332 g/m$^2$; the Desmondur® N3300 hexamethylene diisocyanate resin was employed at 0.403 g/m$^2$; the Desmondur® Z-4370/2 isophorone diisocyanate resin was employed at 0.173 g/m$^2$; and a polytetramethylene ether glycol, Terathane® N1000 (DuPont Co.) (mw 1000) (0.259 g/m$^2$) was added.

E-11 of the Invention-Glycol Within Scope Of Invention

This element was prepared similar to C-2 except that the polycarbonate polyol was employed at 2.365 g/m$^2$; the Desmondur® N3300 hexamethylene diisocyanate resin was employed at 0.378 g/m$^2$; the Desmondur® Z-4370/2 isophorone diisocyanate resin was employed at 0.162 g/m$^2$; and a polytetramethylene ether glycol, Terathane ( N2000 (DuPont Co.) (mw 2000) (0.263 g/m$^2$) was added.

E-12 of the Invention-Glycol Within Scope Of Invention

This element was prepared similar to C-2 except that the polycarbonate polyol was employed at 2.365 g/m$^2$; the Desmondur® N3300 hexamethylene diisocyanate resin was employed at 0.378 g/m$^2$; the Desmondur® Z-4370/2 isophorone diisocyanate resin was employed at 0.162 g/m$^2$; and a copolymer of polytetramethylene ether glycol and caprolactone, Terathane® CL2000 (DuPont Co.) (mw 2000) (0.263 g/m2) was added.

Testing was done as in Example 1 with the following results:

TABLE 2

| Element | Aliphatic Glycol | Prints-to-fail |
|---|---|---|
| C-2 (Control) | (none) | 2 |
| C-3 (Control) | Ethylene Glycol | 2 |
| C-4 (Control) | Ethylene Glycol | 2 |
| C-5 (Control) | Ethylene Glycol | 2 |
| C-6 (Control) | Ethylene Glycol | 2 |
| C-7 (Control) | Polycaprolactone Glycol | 1 |
| C-8 (Control) | Polycaprolactone Glycol | 1 |
| C-9 (Control) | Polycaprolactone Glycol | 2 |
| C-10 (Control) | Polycaprolactone Glycol | 1 |
| E-5 | Polypropylene Glycol | 3 |
| E-6 | Polypropylene Glycol | 4 |
| E-7 | Polypropylene Glycol | 4 |
| E-8 | Polypropylene Glycol | >6 |
| E-9 | Polypropylene Glycol | >6 |
| E-10 | Polytetramethylene Ether Glycol | 4 |

TABLE 2-continued

| Element | Aliphatic Glycol | Prints-to-fail |
|---|---|---|
| E-11 | Polytetramethylene Ether Glycol | >6 |
| E-12 | Copolymer of polytetramethylene ether glycol and caprolactone | 3 |

The above results show that the addition of an aliphatic glycol in accordance with the invention provide an improvement in donor-receiver sticking in comparison to the control elements.

Although the invention has been described in detail with reference to certain preferred embodiments for the purpose of illustration, it is to be understood that variations and modifications can be made by those skilled in the art without departing from the spirit and scope of the invention.

What is claimed is:

1. A dye-receiving element for thermal dye transfer comprising a support having on one side thereof a dye image-receiving layer comprising a crosslinked polymer network being formed by the reaction of a multifunctional isocyanate with:

a) a polycarbonate polyol having at least two terminal hydroxy groups and an average molecular weight of about 1000 to about 10,000, and b) an aliphatic glycol having at least one of the following formulas:

$$HO—(CH_2)_n—OH$$

$$HO—[(CH_2)_n—O]_m—H \text{ or}$$

$$HO—[(CH_2)_5—CO_2]_p—[(CH_2)_n—O]_m—H$$

where n is between about 3 and about 10,
m is between about 3 and about 60, and
p is between about 1 and about 16.

2. The element of claim 1 wherein said crosslinked polymer network has the formula:

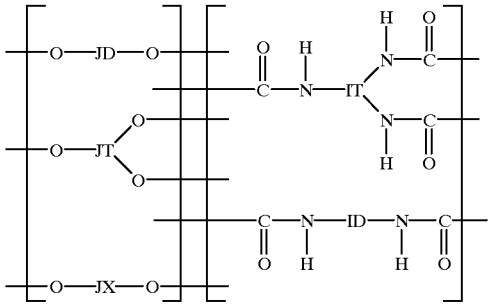

wherein:

JD and JT together represent from 50 to 100 mol % polycarbonate segments derived from a polycarbonate polyol having an average molecular weight of from about 1000 to about 10,000 and from 0 to 50 mol % segments derived from a polyol having a molecular weight of less than about 1000;

JX represents aliphatic glycol segments derived from said aliphatic glycol having an average molecular weight from about 100 to about 11,000; and ID and IT each independently represent aliphatic, cycloaliphatic, arylaliphatic, or aromatic radicals of multifunctional isocyanate units.

3. The element of claim 1 wherein said polycarbonate polyol comprises bisphenol A derived units and diethylene glycol derived units.

4. The element of claim 1 wherein said terminal hydroxy groups of said polycarbonate polyol comprises aliphatic hydroxyl groups.

5. The element of claim 1 wherein said terminal hydroxy groups of said polycarbonate polyols comprise phenolic groups.

6. The element of claim 1 wherein said terminal hydroxy groups of said polycarbonate polyol comprises a mixture of phenolic groups and aliphatic hydroxyl groups.

7. The element of claim 1 wherein at least 50 mol % of said multifunctional isocyanate is at least trifunctional.

8. The element of claim 1 wherein said polyol and multifunctional isocyanate are reacted to form said crosslinked polymer network in amounts such that the equivalent of polyol hydroxyl groups is from 60 to 140% of the equivalent of isocyanate groups.

9. The element of claim 1 wherein said glycol has the formula:

$$HO—[(CH_2)_n—O]_m—H$$

where n is 4, and m is between about 8 and about 40.

10. A process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, wherein said dye image-receiving layer comprises a crosslinked polymer network being formed by the reaction of a multifunctional isocyanate with:

a) a polycarbonate polyol having at least two terminal hydroxy groups and an average molecular weight of about 1000 to about 10,000, and b) an aliphatic glycol having at least one of the following formulas:

$$HO—(CH_2)_n—OH$$

$$HO—[(CH_2)_n—O]_m—H \text{ or}$$

$$HO—[(CH_2)_5—CO_2]_p—[(CH_2)_n—O]_m—H$$

where n is between about 3 and about 10, m is between about 3 and about 60, and p is between about 1 and about 16.

11. The process of claim 10 wherein said crosslinked polymer network has the formula:

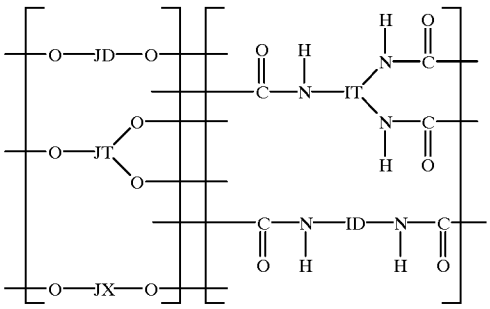

wherein:

JD and JT together represent from 50 to 100 mol % polycarbonate segments derived from a polycarbonate polyol having an average molecular weight of from about 1000 to about 10,000 and from 0 to 50 mol % segments derived from a polyol having a molecular weight of less than about 1000;

JX represents aliphatic glycol segments derived from said aliphatic glycol having an average molecular weight from about 100 to about 11,000; and ID and IT each independently represent aliphatic, cycloaliphatic, arylaliphatic, or aromatic radicals of multifunctional isocyanate units.

12. The process of claim 10 wherein said polycarbonate polyol comprises bisphenol A derived units and diethylene glycol derived units.

13. The process of claim 10 wherein said terminal hydroxy groups of said polycarbonate polyol comprises aliphatic hydroxyl groups.

14. The process of claim 10 wherein said polyol and multifunctional isocyanate are reacted to form said crosslinked polymer network in amounts such that the equivalent of polyol hydroxyl groups is from 60 to 140% of the equivalent of isocyanate groups.

15. The process of claim 10 wherein said glycol has the formula:

$$HO—[(CH_2)_n—O]_m—H$$

where n is 4, and m is between about 8 and about 40.

16. A thermal dye transfer assemblage comprising: (a) a dye-donor element comprising a support having thereon a dye layer and (b) a dye-receiving element comprising a support having thereon a dye image-receiving layer, said dye-receiving element being in a superposed relationship with said dye-donor element so that said dye layer is in contact with said dye image-receiving layer; wherein said dye image-receiving layer comprises a crosslinked polymer network being formed by the reaction of a multifunctional isocyanate with:

a) a polycarbonate polyol having at least two terminal hydroxy groups and an average molecular weight of about 1000 to about 10,000, and b) an aliphatic glycol having at least one of the following formulas:

$$HO—(CH_2)_n—OH$$

$$HO—[(CH_2)_n—O]_m—H \text{ or}$$

$$HO—[(CH_2)_5—CO_2]_p—[(CH_2)_n—O]_m—H$$

where n is between about 3 and about 10, m is between about 3 and about 60, and p is between about 1 and about 16.

17. The assemblage of claim 16 wherein said crosslinked polymer network has the formula:

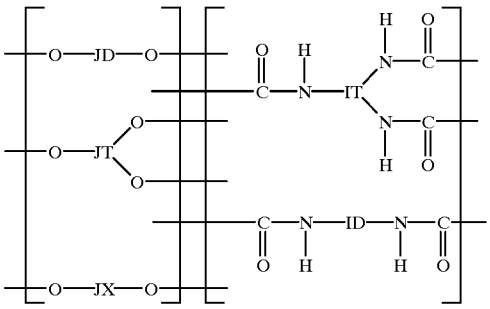

wherein:

JD and JT together represent from 50 to 100 mol % polycarbonate segments derived from a polycarbonate polyol having an average molecular weight of from about 1000 to about 10,000 and from 0 to 50 mol % segments derived from a polyol having a molecular weight of less than about 1000;

JX represents aliphatic glycol segments derived from said aliphatic glycol having an average molecular weight from about 100 to about 11,000; and ID and IT each independently represent aliphatic, cycloaliphatic, arylaliphatic, or aromatic radicals of multifunctional isocyanate units.

18. The assemblage of claim 16 wherein said polycarbonate polyol comprises bisphenol A derived units and diethylene glycol derived units.

19. The assemblage of claim 16 wherein said polyol and multifunctional isocyanate are reacted to form said crosslinked polymer network in amounts such that the equivalent of polyol hydroxyl groups is from 60 to 140% of the equivalent of isocyanate groups.

20. The assemblage of claim 16 wherein said glycol has the formula:

$$HO—[(CH_2)_n—O]_m—H$$

where n is 4, and m is between about 8 and about 40.

* * * * *